US005232374A

United States Patent [19]

Iino

[11] Patent Number: 5,232,374

[45] Date of Patent: Aug. 3, 1993

[54] LOCK EJECT MECHANISM FOR ELECTRICAL CONNECTORS

[75] Inventor: Kouichi Iino, Tokyo, Japan

[73] Assignee: Hirose Electric Co., Ltd., Tokyo, Japan

[21] Appl. No.: 755,809

[22] Filed: Sep. 6, 1991

[30] Foreign Application Priority Data

Sep. 18, 1990 [JP] Japan ..... 2-97718[U]

[51] Int. Cl.[5] ..... H01R 13/62

[52] U.S. Cl. ..... 439/157; 439/153

[58] Field of Search ..... 439/152-160, 439/372

[56] References Cited

U.S. PATENT DOCUMENTS

| | | | |
|---|---|---|---|
| 4,196,954 | 4/1980 | Collignon et al. | 439/152 |
| 4,632,588 | 12/1986 | Fitzpatrick | 439/157 |
| 4,787,858 | 11/1988 | Killian, Jr. | 439/372 |
| 5,017,149 | 5/1991 | Hatanaka | 439/157 |
| 5,057,029 | 10/1991 | Noorily | 439/157 |

*Primary Examiner*—David Pirlot
*Attorney, Agent, or Firm*—Kanesaka & Takeuchi

[57] ABSTRACT

A lock eject mechanism for a pair of electrical connectors includes a first housing (210) for a first electrical connector (200); a lock eject unit (220) provided on opposite sides of the first housing; a second housing (110) for a second electrical connector (100); and a lock eject receiver (120) provided on opposite sides of the second housing for receiving the lock eject units for engagement. The lock eject unit includes a pair of lock eject levers (221) pivoted to opposite sides of the first housing and each having a lock portion (223) at its front section and a lock operation portion (222) at its rear section. The lock eject receiver includes a pair of lock members (121) for engagement with the lock portion of the lock eject levers to lock a plug-in condition between the first and second electrical connectors; a pair of guiding members (123) provided in the vicinity of the lock members for guiding the lock portions of the lock eject levers to the lock members for engagement when first and second electrical connectors are plugged in; and a pair of eject members (122) for exerting ejecting forces upon the lock portions when the lock operation portions are squeezed to pull the first electrical connector out of the second electrical connector.

2 Claims, 2 Drawing Sheets

LOCK EJECT MECHANISM FOR ELECTRICAL CONNECTORS

BACKGROUND OF THE INVENTION

1. Field of the Invention

The present invention relates to lock eject mechanisms for electrical connectors.

2. Description of the Prior Art

Japanese U.M. Patent Application Kokoku No. 58-55580 discloses an electrical connector which includes a housing mountable on a circuit board and a pair of lock levers provided on opposite sides of the housing which not only locks the plug-in condition of a pair of electrical connectors but also provides a plug-out force for facilitating the plug-out operation. When a connector with a cable is plugged into a connector having opened lock levers, the lock levers are closed to lock a plug-in condition between these connectors. To pull it out of the mating connector, the lock levers are opened, exerting a plug-out force upon the connector, bringing it to a half plug-out condition. Then, the connector is removed from the mating connector completely.

However, in the above connector, it is necessary to open the lock levers of the mating connector with both hands and then apply a pulling force thereon so that it is difficult to remove the connector from the mating connector.

SUMMARY OF THE INVENTION

Accordingly, it is an object of the invention to provide a lock eject mechanism for electrical connectors which enables one to readily pull one connector out of the other connector.

According to the invention there is provided a lock eject mechanism for a pair of electrical connectors, which includes a first housing for a first electrical connector; a lock eject unit provided on opposite sides of the first housing; a second housing for a second electrical connector; and a lock eject receiver provided on opposite sides of the second housing for receiving the lock eject units for engagement.

The lock eject unit includes a pair of lock eject levers pivoted to opposite sides of the first housing, the lock eject levers each having a lock portion at its front section and a lock operation portion at its rear section.

The lock eject receiver includes a pair of lock members for engagement with the lock portion of the lock eject levers to lock a plug-in condition between the first and second electrical connectors; a pair of guiding members provided in the vicinity of the lock members for guiding the lock portions of the lock eject levers to the lock members for engagement when first and second electrical connectors are plugged in; and a pair of eject members for exerting ejecting forces upon the lock portions when the lock operation portions are squeezed to pull the first electrical connector out of the second electrical connector.

With the above lock eject mechanism, by simply squeezing and pulling the lock operation portions, it is possible to plug out one connector from the other.

The above and other objects, features, and advantages of the invention will be more apparent from the following description when taken in conjunction with the accompanying drawings.

DESCRIPTION OF THE PREFERRED EMBODIMENT

Figure 1:
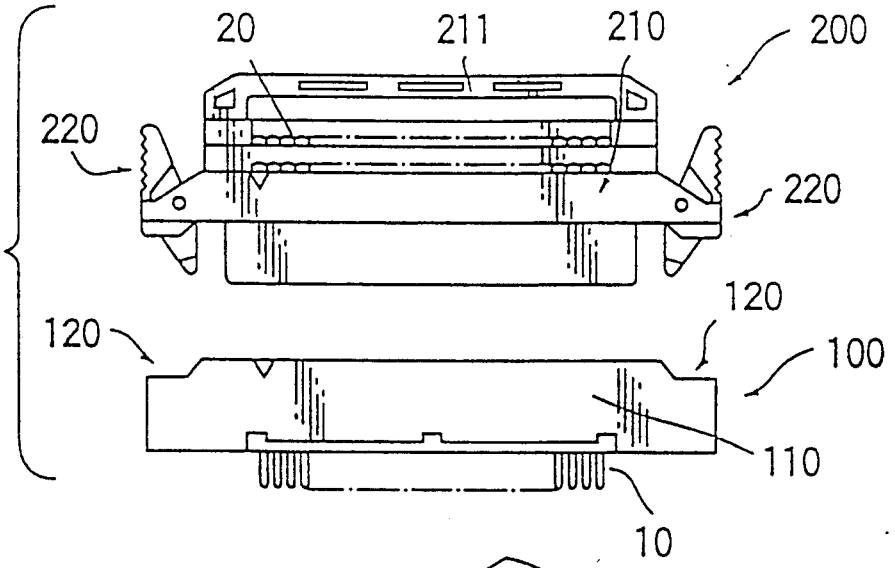
FIG. 1 is a side view of a pair of electrical connectors having a lock eject mechanism according to an embodiment of the invention.

In FIG. 1, a connector assembly consists of a header connector 100 to be mounted on a circuit board and a socket connector 200 to be plugged in and out of the header connector 100. The header connector 100 includes a header housing 110 having a number of contact elements 10 and a pair of lock eject receivers 120 provided on opposite sides of the header housing 110. The socket connector 200 includes a socket housing 20 which has a number of contact elements 20 each brought into contact with a corresponding contact element 10 of the header connector 100. A cable retainer 211 is attached to the rear end of the socket housing 210 for holding in place a number of insulated conductors of a cable which are connected to the contact elements 20. A pair of lock eject mechanisms 220 are affixed to opposite sides of the socket housing 210.

Figure 2:
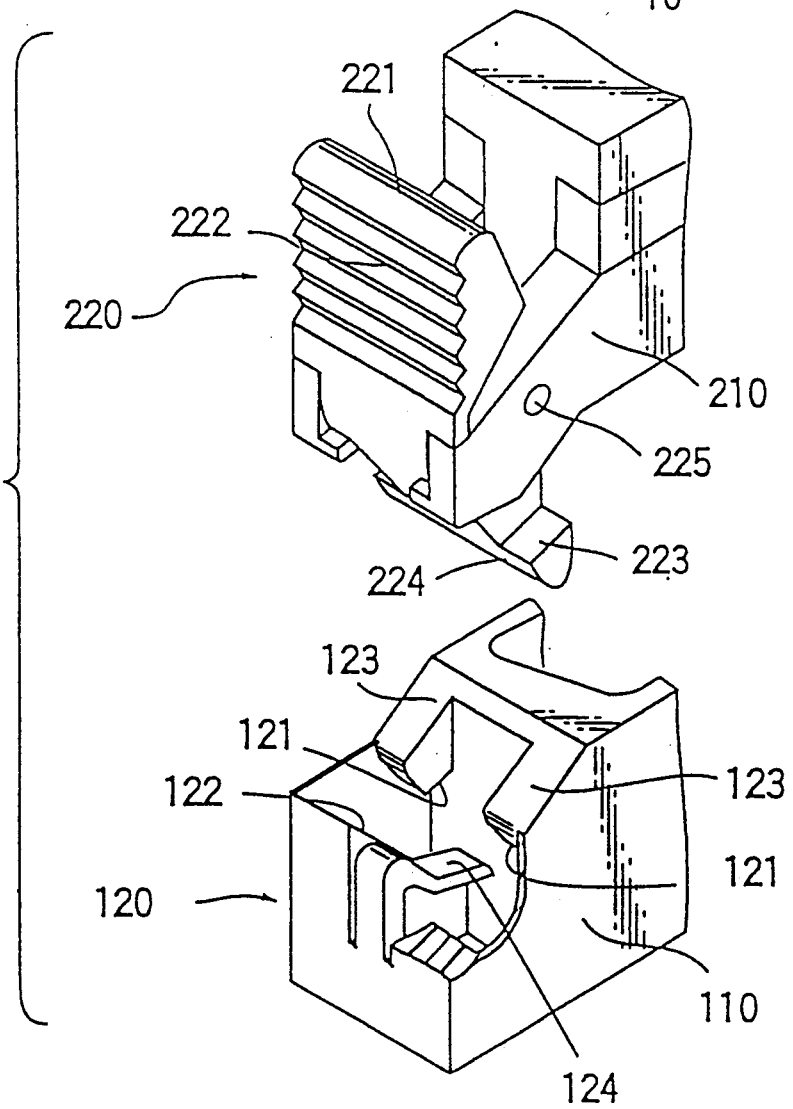
FIG. 2 is a partially cutaway perspective view of the lock eject mechanism.

In FIG. 2, a lock eject lever 221 of the lock eject mechanism 220 is pivoted at 225 to a side of the socket housing 210. The lock eject lever 221 has a pair of lock craws 223 in the front portion and a lock knob 222 in the rear portion. The lock eject receiver 120 has a lock portion with a pair of shoulders 121 for engagement with the lock claws 223 to lock a plug-in condition between the header connector 100 and the socket connector 200. The lock portion 121 has a pair of downwardly and outwardly sloped surfaces 123 for guiding the lock claws 223 to their shoulders when the socket connector 200 with its lock eject levers 221 closed is plugged into the head connector 100. A pair of downwardly and inwardly sloped surfaces 122 are opposed to and slightly below the outwardly sloped surfaces 123. (Another inwardly sloped surface 122 is cutaway in the figure for showing a biasing spring 124.) These inwardly sloped surfaces 122 guide the lock claws 223 of the lock eject levers 221 to the lock shoulders 121 when the socket connector 200 with the lock eject lever 221 opened is plugged into the header connector 100. These inwardly sloped surfaces 122 also constitute ejecting portions for exerting ejecting forces upon the front ends 224 of the lock claws 223 when the lock knobs 222 of the lock eject levers 221 are squeezed to pull the socket connector 200 out of the header connector 100. The biasing spring 124 extends between the inwardly sloped surfaces 122 to bias the lock claws 223 to the lock shoulders 121. All of the lock shoulders 121, outwardly sloped surfaces 123, inwardly sloped surfaces 122, bias spring 124 are molded integrally with the header housing 110 from a plastic material or the like.

Figure 3:
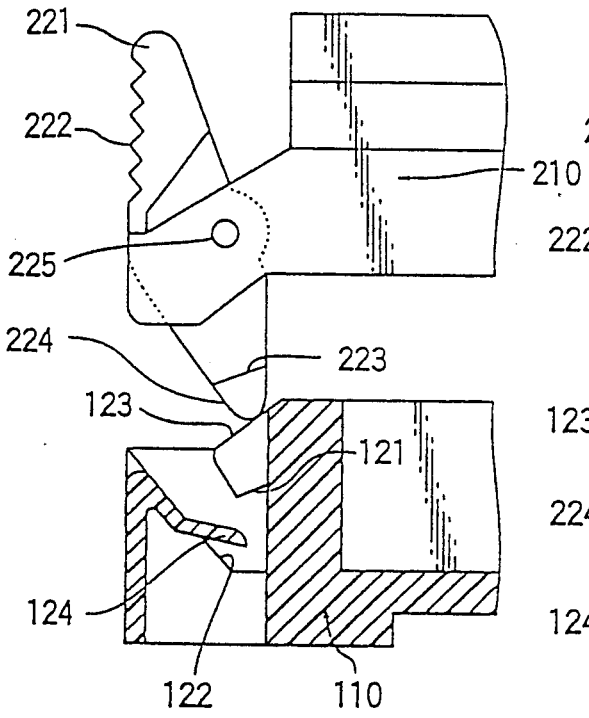
FIGS. 3–6 are partially sectional side views of the lock eject mechanism useful for explaining how the lock eject mechanism works.

In FIG. 3, when the socket connector 200 with the lock eject levers 221 closed is plugged into the header connector 100, the front ends 224 of the lock eject levers 221 abut on the outwardly sloped surfaces 123 of the lock eject receivers 120. As the socket connector 200 is further inserted into the header connector 100, the front ends 224 of the lock eject levers 221 slide on the outwardly sloped surfaces 123 so that the lock eject levers 221 are turned outwardly about the pivots 225 as shown in FIG. 4.

Figure 4:
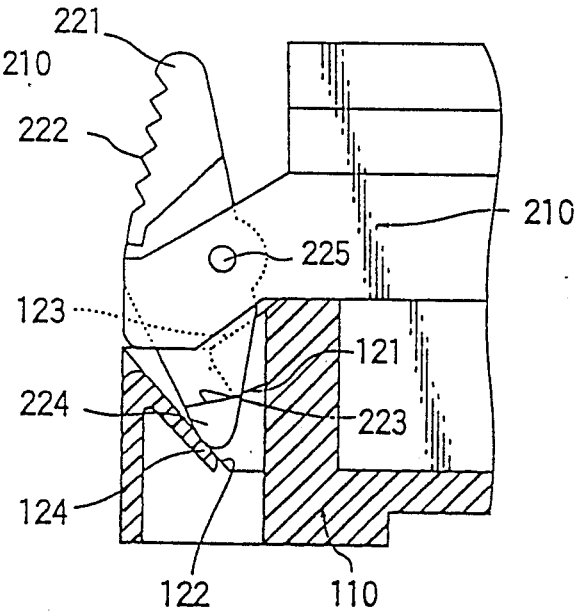

In FIG. 4, the front ends 224 of the lock eject levers 221 slide on the inwardly sloped surfaces 122 and are biased inwardly by the biasing springs 124 so that the lock eject levers 221 are turned inwardly about the pivots 225.

Figure 5:
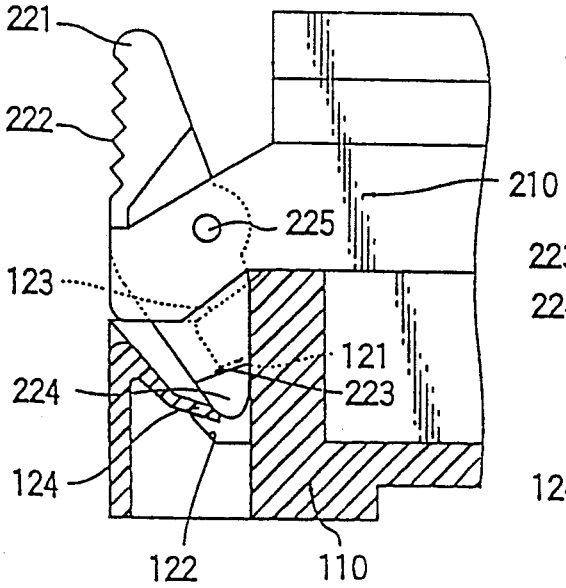

In FIG. 5, when the socket connector 200 is fitted in the header connector 100 completely, the lock claws 223 of the lock ejector levers 221 engage the lock shoulders 121. This lock condition is held by the biasing force of the biasing springs 124.

Figure 6:
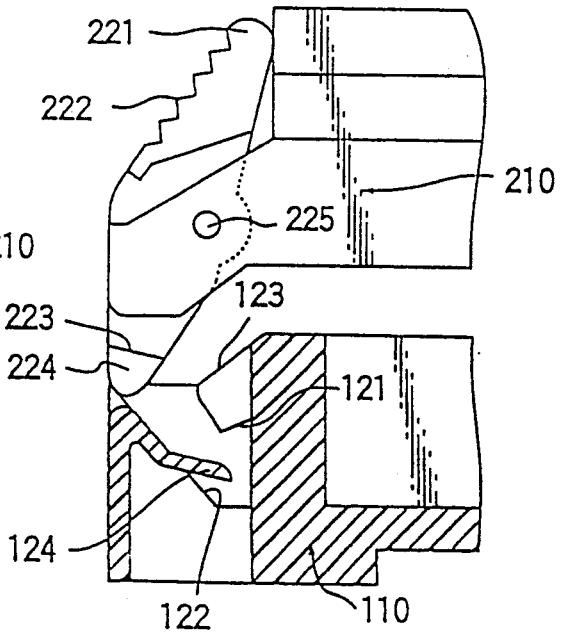

In FIG. 6, when the socket connector 200 with the lock eject levers 221 opened is plugged into the header connector 100, the front ends 224 of the lock eject levers 221 abut on the inwardly sloped surfaces 122 of the lock eject receivers 120. As the socket connector 200 is further inserted into the header connector 100, the front ends 224 of the lock eject levers 221 slide along the inwardly sloped surfaces 122 so that the lock eject levers 221 are turned inwardly about the pivots 225 as shown in FIG. 4.

In FIG. 4, the front ends 224 of the lock eject levers 221 are subjected to not only the cam effects of the inwardly sloped surfaces 122 but also the inward bias of the biasing springs 124 so that the lock eject levers 221 are turned further inwardly about the pivots 225. As FIG. 5 shows, when the socket connector 200 is fitted in the header connector 100 completely, the lock claws 223 of the lock eject levers 221 engage the lock shoulders 121. This engagement is held by the biasing force of the biasing springs 124.

To pull the socket connector 200 out of the header connector 100, the lock knobs 222 of the lock eject levers 221 are squeezed to open the lock eject levers 221. Consequently, the front ends 224 of the lock claws 223 are moved outwardly against the biasing force of the biasing springs 124 for abutment upon the inwardly sloped surfaces 122 as shown in FIG. 4. When the lock knobs 222 are further squeezed, the lock claws 223 are released from the lock shoulders 121, and the front ends 224 of the lock eject levers 221 are subjected to the cam effect of the inwardly sloped surfaces 122. The cam effects bring the lock eject levers 221 away from the header connector 100, exerting forces which tend to pull the socket connector 200 out of the header connector. In other words, when the lock knobs 222 of the lock eject levers 221 are simply squeezed, ejecting forces automatically exert upon the socket connector 200 to pulling it out of the header connector 100 as shown in FIG. 6. Thus, the socket connector 200 is just pulled out of the header connector 100 completely.

In the above embodiment, the surfaces for exerting ejecting forces are spaced so away from the pivots of the lock eject levers that small forces exerting upon the lock knobs produce large ejecting forces. Since the front ends of the lock claws constitute an ejecting portion the amount of ejection becomes large. The biasing springs always exert biasing forces which tend to urge the lock claws against the lock shoulders, thus preventing accidental release of the lock.

What is claimed is:

1. A lock eject mechanism for a pair of electrical connectors, comprising:

a first housing for a first electrical connector;

a lock eject unit provided on opposite sides of said first housing;

a second housing for a second electrical connector;

a lock eject receiver provided on opposite sides of said second housing for receiving said lock eject unit for engagement, said lock eject unit having a pair of lock eject levers pivoted to opposite sides of said first housing, said lock eject levers each having a lock claw at its front portion and a lock eject knob at its rear portion, and said lock eject receiver having a pair of lock shoulders for engagement with said lock claws of said lock eject levers to lock a plug-in condition between said first and second electrical connectors and a pair of eject members each having an inwardly sloped surface for exerting, when said lock eject knobs are squeezed inwardly to turn said front portion of said lock eject lever outwardly, an ejecting force upon said front portion of said lock eject lever, thereby ejecting said first electrical connector from said second electrical connector.

2. A lock eject mechanism for a pair of electrical connectors, comprising:

a first housing for a first electrical connector;

a lock eject unit provided on opposite sides of said first housing;

a second housing for a second electrical connector;

a lock eject receiver provided on opposite sides of said second housing for receiving said lock eject unit for engagement, said lock eject unit having a pair of lock eject levers pivoted to opposite sides of said first housing, said lock eject levers each having a lock claw at its front portion and a lock eject knob at its rear portion, and said lock eject receiver having a pair of lock shoulders for engagement with said lock claws of said lock eject levers to lock a plug-in condition between said first and second electrical connectors and a pair of eject members each having an inwardly sloped surface for exerting, when said lock eject knobs are squeezed to turn said front portion of said lock eject lever, an ejecting force upon said front portion of said lock eject lever, thereby ejecting said first electrical connector from said second electrical connector, wherein said lock eject receiver comprising a pair of biasing springs with a free end thereof bend more inwardly than the inwardly sloped surfaces for biasing said front portions of said eject levers toward said lock shoulders for assuring a lock between said first and second electrical connector with little or no play.

* * * * *